US007934974B2

(12) United States Patent
Kelly

(10) Patent No.: US 7,934,974 B2
(45) Date of Patent: May 3, 2011

(54) COMPACT STYLING HEAD

(75) Inventor: Emily Kelly, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 1340 days.

(21) Appl. No.: 11/444,737

(22) Filed: May 31, 2006

(65) Prior Publication Data

US 2006/0286894 A1 Dec. 21, 2006

Related U.S. Application Data

(60) Provisional application No. 60/687,374, filed on Jun. 3, 2005.

(51) Int. Cl.
*A63H 13/02* (2006.01)
*A45D 33/22* (2006.01)

(52) U.S. Cl. ..... 446/296; 446/73; 446/487; 446/319; 446/391; 132/293; 132/295; 132/298

(58) Field of Classification Search ..... 446/296, 446/319, 391, 73, 472, 487; 132/293–294, 132/295, 301, 298; 434/94; 220/235, 581, 220/823

See application file for complete search history.

(56) References Cited

U.S. PATENT DOCUMENTS

| | | | | |
|---|---|---|---|---|
| 1,518,594 | A | 12/1924 | Marble | |
| 1,655,365 | A | 1/1928 | Gurtov | |
| 1,993,938 | A | 3/1935 | McDonald | |
| 2,141,031 | A * | 12/1938 | Conant | 132/301 |
| 2,165,476 | A | 7/1939 | Greneker | |
| 2,190,273 | A | 2/1940 | Shapiro | |
| 2,381,663 | A | 8/1945 | Greneker | |
| 2,485,814 | A | 10/1949 | Cohan | |
| 2,919,502 | A * | 1/1960 | Frances | 434/94 |
| 2,968,104 | A | 1/1961 | Ito | |
| 3,048,941 | A | 8/1962 | Shaw | |
| 3,101,557 | A | 8/1963 | Watlington et al. | |
| 3,162,976 | A | 12/1964 | Beebe et al. | |
| 3,325,917 | A | 6/1967 | Kinnaman | |
| D210,055 | S * | 1/1968 | Walker | D6/453 |
| 3,458,943 | A | 8/1969 | Trowbridge | |
| 3,500,578 | A | 3/1970 | Albert | |
| 3,552,549 | A | 1/1971 | Creese et al. | |
| 3,765,123 | A | 10/1973 | Terzian | |
| 3,808,736 | A | 5/1974 | Terzian et al. | |
| 4,221,060 | A | 9/1980 | Moskowitz et al. | |
| 4,361,981 | A | 12/1982 | Reiling et al. | |
| 4,403,962 | A | 9/1983 | La Vista | |
| 4,559,021 | A | 12/1985 | Wittenberg et al. | |
| 4,596,528 | A * | 6/1986 | Lewis et al. | 434/270 |
| 4,776,796 | A | 10/1988 | Nossal | |
| 4,810,196 | A | 3/1989 | Walker | |
| 5,180,325 | A | 1/1993 | Eddins et al. | |

(Continued)

FOREIGN PATENT DOCUMENTS

| | | |
|---|---|---|
| EP | 614628 | 9/1994 |

*Primary Examiner* — Gene Kim
*Assistant Examiner* — Scott Young
(74) *Attorney, Agent, or Firm* — Kolisch Hartwell, PC

(57) ABSTRACT

A toy container is provided including a multiple portions. In some embodiments, the device has several portions that are movable from a closed configuration, in which the portions overlay one another, to an open configuration, in which a doll section and cosmetics are accessible.

13 Claims, 5 Drawing Sheets

U.S. PATENT DOCUMENTS

| | | | | | |
|---|---|---|---|---|---|
| 5,320,535 | A | | 6/1994 | Min | |
| 5,358,407 | A | | 10/1994 | Lainer | |
| 5,363,969 | A | | 11/1994 | Shen | |
| 5,398,706 | A | | 3/1995 | Epstein | |
| 5,437,294 | A | | 8/1995 | Ebbets, III et al. | |
| 5,607,338 | A | | 3/1997 | Landi | |
| 5,655,553 | A | | 8/1997 | Giese et al. | |
| 5,897,416 | A | * | 4/1999 | Barrows | 446/147 |
| 5,971,763 | A | | 10/1999 | Yau | |
| 6,070,749 | A | * | 6/2000 | Joulia | 220/4.22 |
| 6,109,921 | A | * | 8/2000 | Yau | 434/100 |
| 6,227,208 | B1 | | 5/2001 | Imbert | |
| 6,474,345 | B2 | | 11/2002 | Rodriquez et al. | |
| 6,484,731 | B1 | | 11/2002 | Lacout | |
| 6,558,221 | B1 | * | 5/2003 | Yang | 446/100 |
| 6,631,806 | B2 | * | 10/2003 | Jackson | 206/581 |
| 6,688,316 | B1 | | 2/2004 | Klug | |
| 6,736,692 | B1 | | 5/2004 | Hoyos-Zermeno et al. | |
| 6,766,907 | B2 | * | 7/2004 | Jackson | 206/581 |
| 6,926,532 | B1 | | 8/2005 | Brattesani | |
| 7,165,559 | B1 | * | 1/2007 | Goodman | 132/294 |
| 2005/0074739 | A1 | | 4/2005 | Shapiro | |

* cited by examiner

COMPACT STYLING HEAD

CROSS-REFERENCE TO RELATED APPLICATIONS

This application claims priority under 35 U.S.C. 119(e) to U.S. Provisional Patent Application No. 60/687,374 entitled "COMPACT STYLING HEAD," filed Jun. 3, 2005, the disclosure of which is incorporated herein by reference.

BACKGROUND

Children and young adults are often interested in imitating adults with regard to personal appearance. For example, girls play dress-up with dolls and their own appearances. To practice applying cosmetics and styling hair, styling heads may be used that include portions of manikins having washable faces and/or hair so they may be repeatedly used to practice beauty preparations. However, styling heads are often rather large and difficult to package in a compact manner appropriate for traveling.

Doll and manikin components incorporating cosmetic application and/or hair styling are found in U.S. Pat. Nos. 2,919,502, 3,048,941, 4,361,981, and 4,559,021 the disclosures of which are incorporated herein by reference. Further examples of stylable components, portable vanities, and cameos are found in U.S. Pat. Nos. 1,518,594, 1,655,365, 1,993,938, 2,141,031, 2,165,476, 2,190,273, 2,381,663, 2,485,814, 2,968,104, 3,101,557, 3,162,976, 3,325,917, 3,458,943, 3,500,578, 3,552,549, 3,765,123, 3,808,736, 4,221,060, 4,403,962, 4,596,528, 4,776,796, 4,810,196, 5,180,325, 5,320,535, 5,358,407, 5,363,969, 5,437,294, 5,607,338, 5,655,553, 5,971,763, 6,109,921, 6,474,345, 6,484,731, 6,631,806, 6,688,316, 6,736,692, 6,766,907, 6,926,532; U.S. Patent Application Publication No. 2005/0074739; and European Patent Application No. 614,628, the disclosures of which are incorporated herein by reference, in their entirety and for all purposes.

SUMMARY

The present disclosure relates generally to a beauty preparation practice device. More specifically, it relates to a compact toy that allows a user to practice applying cosmetics and/or styling hair.

The advantages of the disclosed beauty preparation practice device may be understood more readily after a consideration of the drawings and the Detailed Description.

DETAILED DESCRIPTION

Figure 1:
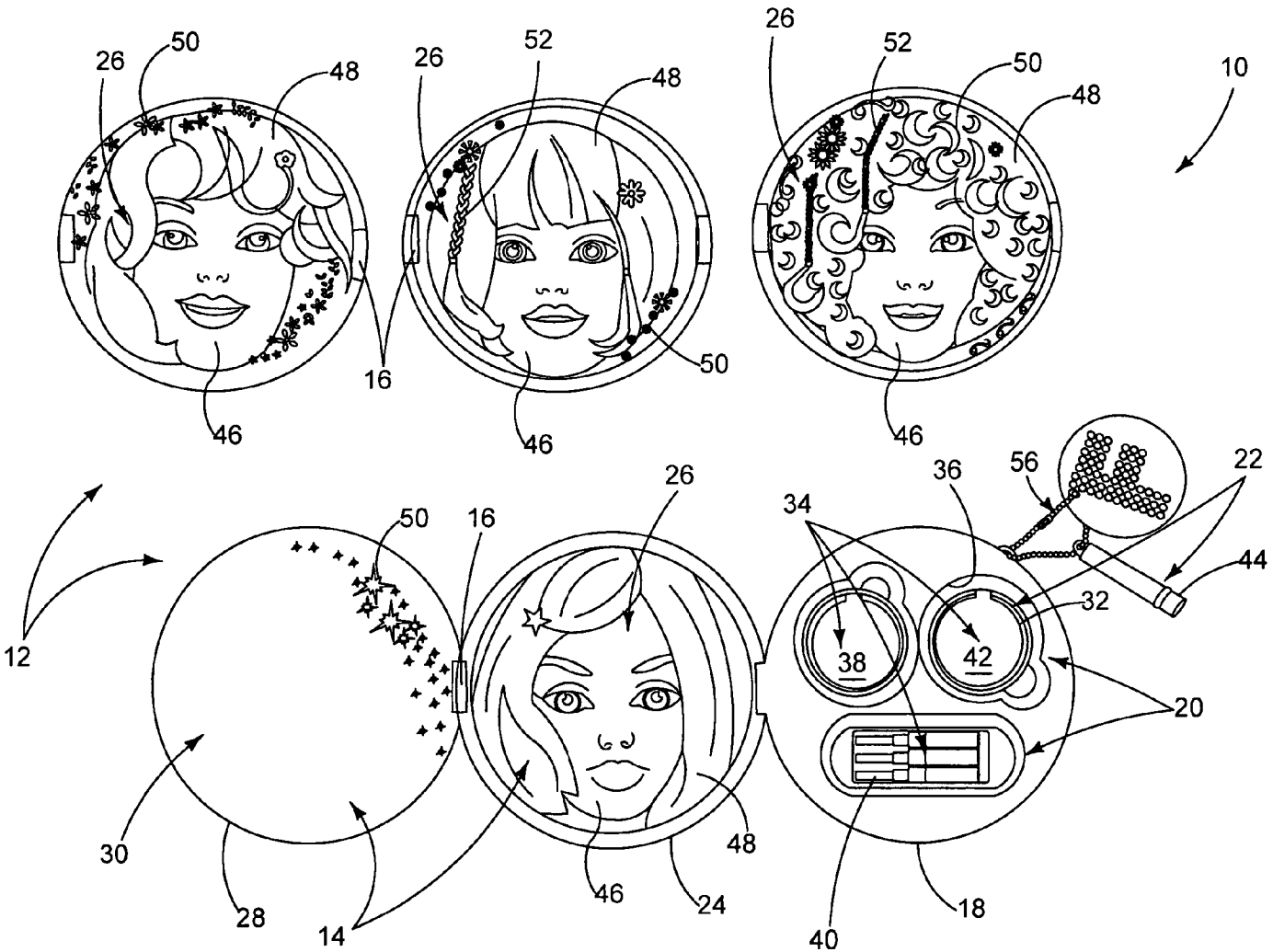
FIG. 1 is a front view of several examples of a multi-portioned beauty preparation practice device including a doll section and cosmetics.

The present disclosure provides toys that may be used to practice cosmetic application and hair styling. As a first example, FIG. 1 illustrates a multi-portioned beauty preparation device 10. The device may be configured to be compact and easy to transport while providing an aesthetically pleasing appearance. Device 10 may take the form of a toy styling compact 12, such as the tri-fold container shown in FIGS. 1-4; however, any suitable number of portions may be used. Device 10 may be configured to resemble an adult cosmetic product, such as a powder compact, or may resemble various jewelry or accessories, such as a brooch, locket, hair clip, brush, and the like.

As shown, the device may include several portions or panels 14 that may be moved relative to one another using any suitable mechanism, such as hinges, pins, screw threads along the perimeter of each portion, and the like. The exemplary panels depicted in FIGS. 1-4 are shown coupled to one another by hinges 16.

Each portion 14 may serve a distinct function and/or provide one or more features. In the exemplary device of FIG. 1, a first panel 18 may be provided to house one or more storage areas 20. The storage areas may include storage receptacles, such as drawers or other closeable compartments, or be open spaces configured to receive other storage receptacles. The storage receptacles may house beauty preparation items 22. A second panel 24 may provide a washable doll section 26 to which beauty preparation items 22 may be applied. A third panel 28 may form a protective cover 30 for the doll section. In some configurations, a plurality of similar panels may be provided depending on the desired features of the device.

Figure 2:
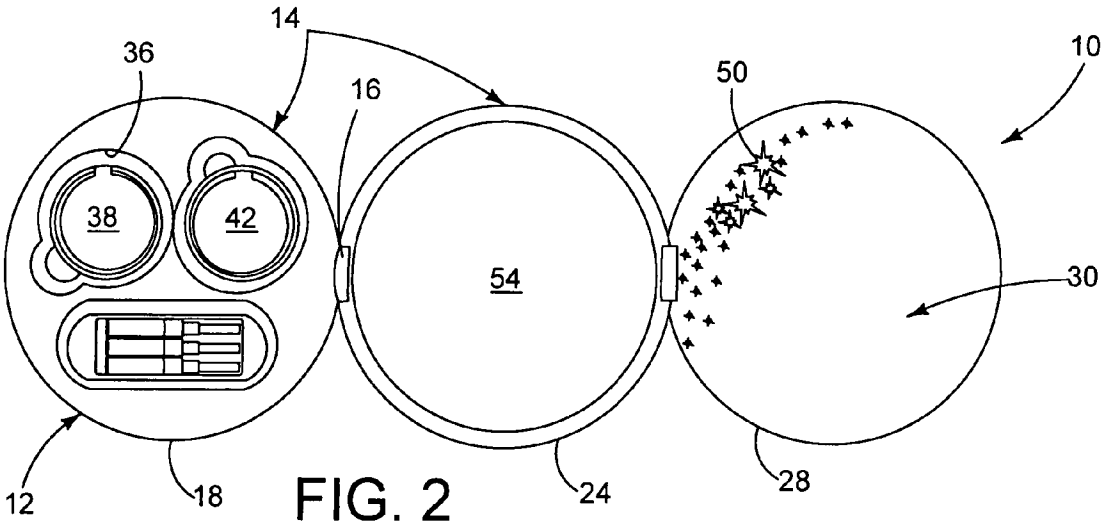
FIG. 2 is a rear view of the device of FIG. 1 including a mirror and cosmetics.

As illustrated in FIGS. 1 and 2, beauty preparation items 22 may include one or more cosmetic receptacles 32 having cosmetics 34 suitable for application to the doll section. The receptacles may be housed in storage areas 20. The receptacles may be coupled to the panel through any suitable method and mechanism, including, but not limited to press fitting the receptacles into suitably dimensioned portions of storage areas 20. As shown in the exemplary device of FIGS. 1, 2, and 4, the storage areas of first panel 18 may take the form of one or more cavities 36 configured to receive the cosmetic receptacles. In some configurations, the cavities extend through the panel forming apertures. Consequently, the cosmetic receptacles are accessible and/or removable from both a front side and a back side of the first panel. The receptacles may be configured to be opened from a front side and a back side of the first panel, so that the receptacles need not be removed from the panel to be opened. Storage areas 20 may be configured to provide a flush surface with the cosmetic receptacles.

Cosmetics 34 may include any of a variety of cosmetic types, for example, eye shadow 38, pencils 40, lip gloss 42, among others, and one or more cosmetic applicators 44, such as a brush and/or sponge, as shown in FIGS. 1-2 and 4-6. It should be appreciated that other types of cosmetics may be included, such as blush and mascara, and a variety of receptacles may be used to house each type of cosmetic. Cosmetics 34 may be adapted for application to doll section 26 or a user's face.

Doll section 26 of the second panel may include a facial sculpt 46 that may resemble a human female face. Doll section 26 may include only a face, or may extend to include a neck and shoulders so that jewelry may be included or hair styles of various lengths may be practiced. It should be appreciated that device 10 may take a variety of other forms upon which artistic renderings may be made, such as clowns, animals, graffiti walls, etc. In some versions, doll section 26 may reflect the appearance of a famous character, such as a political figure, celebrity, book, or film personality.

Doll section 26 may be two-dimensional, or three-dimensional. In the examples shown in FIGS. 1-5, the doll section is a three-dimensional version in which the contours of a girl's face are present from the ears forward. In some configurations, doll section 26 may be a two-dimensional picture of a face. Both two-dimensional and three-dimensional faces may be included in device 10. For example, the back side of the three-dimensional face may include a two-dimensional version of that face or a different face.

Device 10 may be available with a variety of facial sculpts 46. Users may collect the variety of facial sculpts as a set. The facial sculpts may be different from one another, as illustrated by the examples shown in FIG. 1, to provide a variety of different ethnic-based complexions and eye and hair colors so that each user is able to enjoy a facial sculpt that is similar to her own.

Doll section 26 may further include hair 48. Hair 48 may include natural hair or may consist of another natural fiber, such as wool, or a durable synthetic material, such as nylon. The hair may be affixed to doll section 26 using any appropriate method including, but not limited to, adhesive, stitching, and other suitable methods of rooting. Hair 48 may couple to doll section 26 in a manner that allows for adjustments in the length of hair that is visible. The hair may be removable from the doll section so that a user may change the color of the hair or replace the hair if it should become damaged.

Facial sculpt 46 and hair 48 may be made of washable materials. Hair 48 may be washable to remove any cosmetics that were accidentally spread into the hair or any temporary hair dyes that were applied to the hair. Facial sculpt 46 may be washable so that the user may practice a variety of cosmetic applications.

As previously mentioned, third panel 28 may form a protective cover 30 for the second panel, such as for doll section 26. Cover 30 may protect doll section 26 and preserve any cosmetic and hair style changes that a user has completed. As shown in FIGS. 1-3 and 5, cover 30 may be substantially transparent or opaque and/or include decorations 50, such as images of stars, flowers, ribbons, etc., configured to overlay the doll section and further alter the appearance of doll section 26 once cover 30 is closed.

Figure 3:
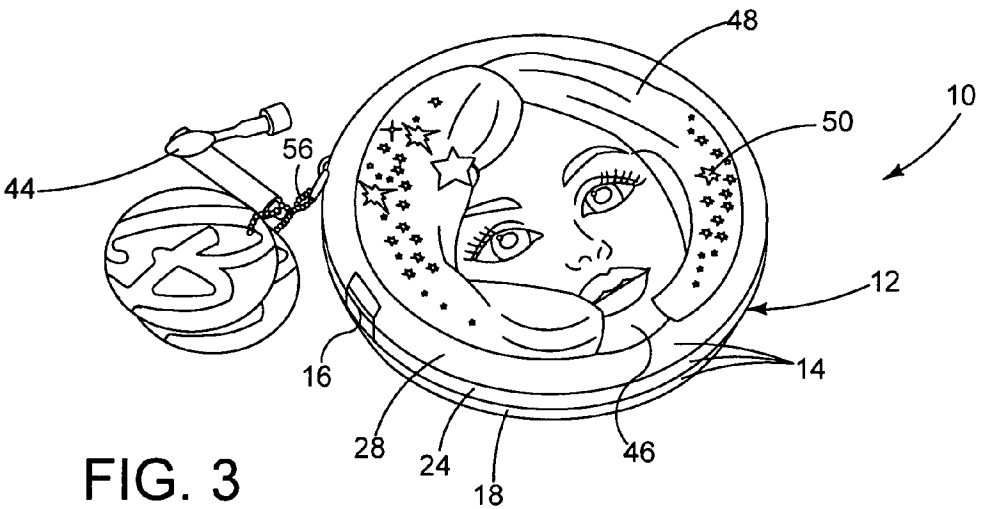
FIG. 3 illustrates an exemplary device in a closed configuration in which a protective cover extends over the doll section and the cosmetics are folded behind the doll section.
Figure 4:
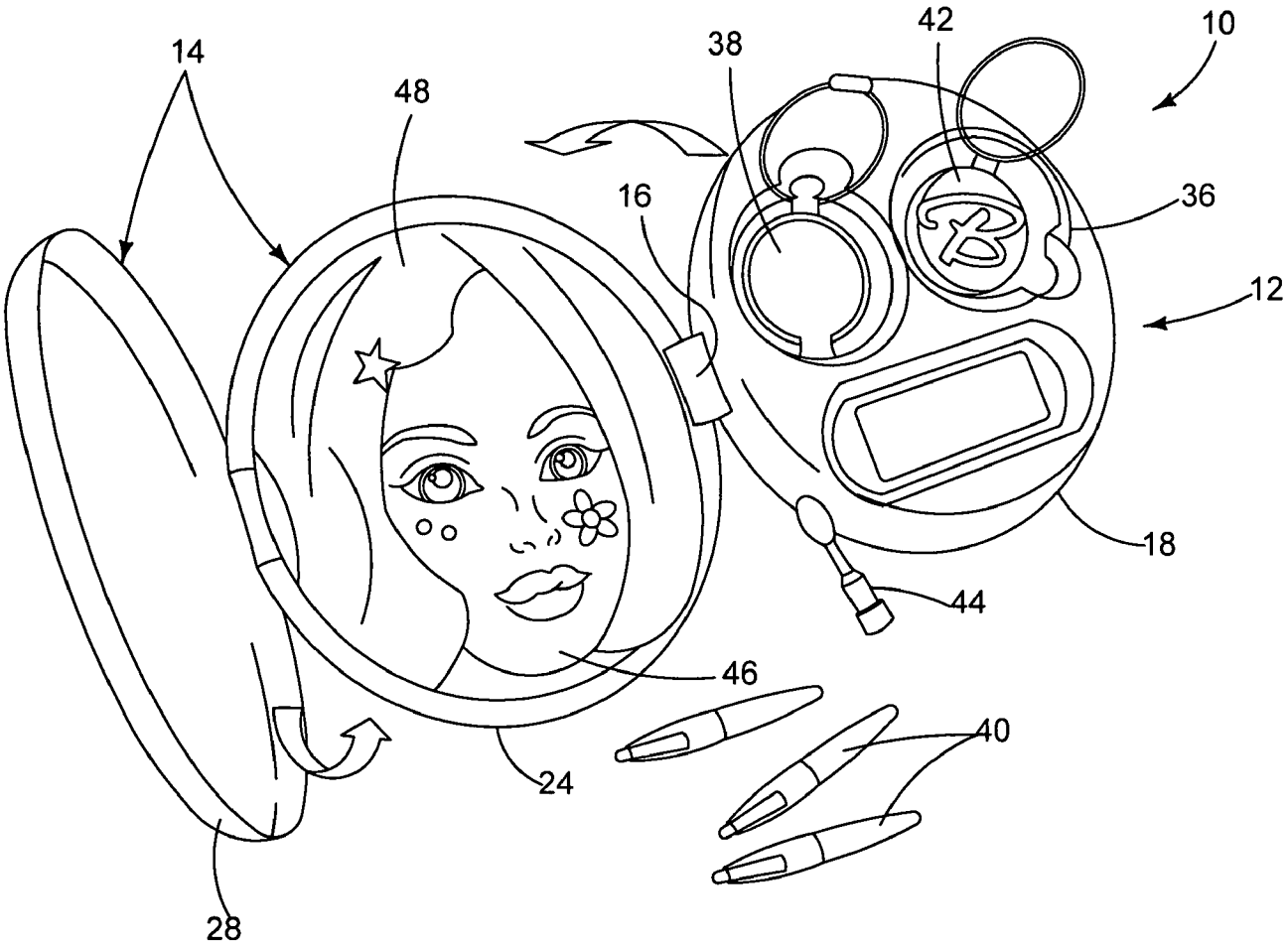
FIG. 4 illustrates an exemplary device in an open configuration in which the doll section is accessible for application of cosmetics to the doll section.

Portions 14 may be configured to fold flat against one another so that the device is compact and suitable for traveling as illustrated in FIGS. 1 and 3. Hinges 16 may be biased to maintain the portions in a closed or open configuration. In some versions of the device, a clasp may be provided to secure the panels in the closed configuration.

Beauty preparation items 22 may include accessories 52 that may be coupled to the facial sculpt or hair of the doll section. The accessories may include jewelry and hair extensions that may be coupled to the doll section. Device 10 may include additional accessories, such as stickers, face gems, glitter, hair barrettes, hair extensions, and the like depending on the particular configuration of device 10.

Device 10 may include a mirror 54 so that a user may apply cosmetics to herself. Mirror 54 may be coupled to a side of the second panel opposite the doll section, as shown in FIG. 2.

The device may include a fastening member 56 so that the device may be temporarily or permanently coupled to an item of clothing, a backpack, purses, key rings, and the like. Fastening member 56 may include chains, pins, and the like. Alternatively or additionally, fastening member 56 may couple one or more of cosmetic receptacles 32 to device 10. As shown in FIG. 1, fastening member 56 may couple applicator 44 to device 10.

Figure 5:
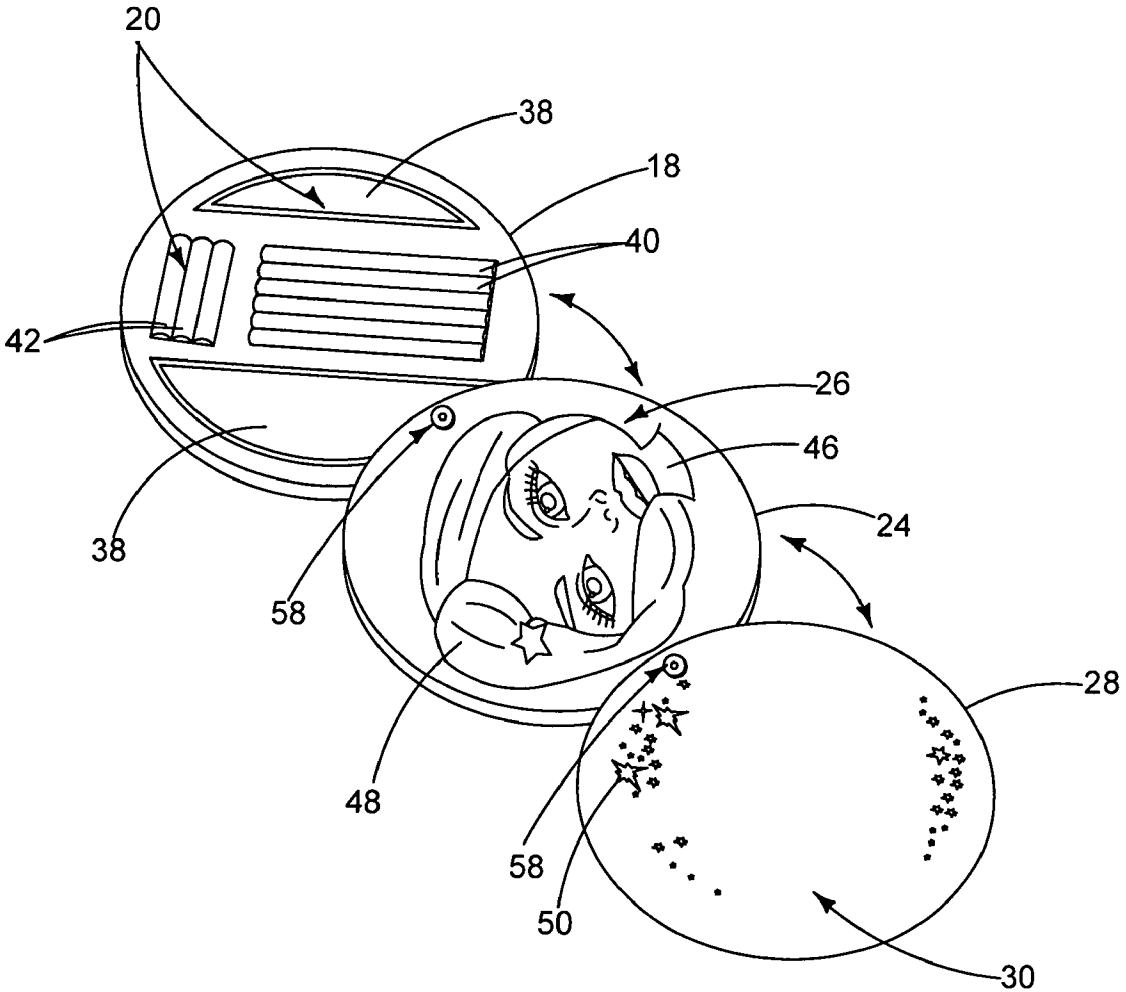
FIG. 5 illustrates a multi-portioned exemplary device in an open configuration in which the panels are coupled to one another by pin joints.

FIG. 5 illustrates another exemplary device 10. As shown, portions 14 may be coupled together by pin joints 58. In such a configuration, the portions may remain in parallel planes and rotate relative to one another at the pin joints. FIG. 5 also illustrates an additional configuration for cosmetics 34 in which a plurality of different sized and shaped storage areas 20 are provided.

Figure 6:
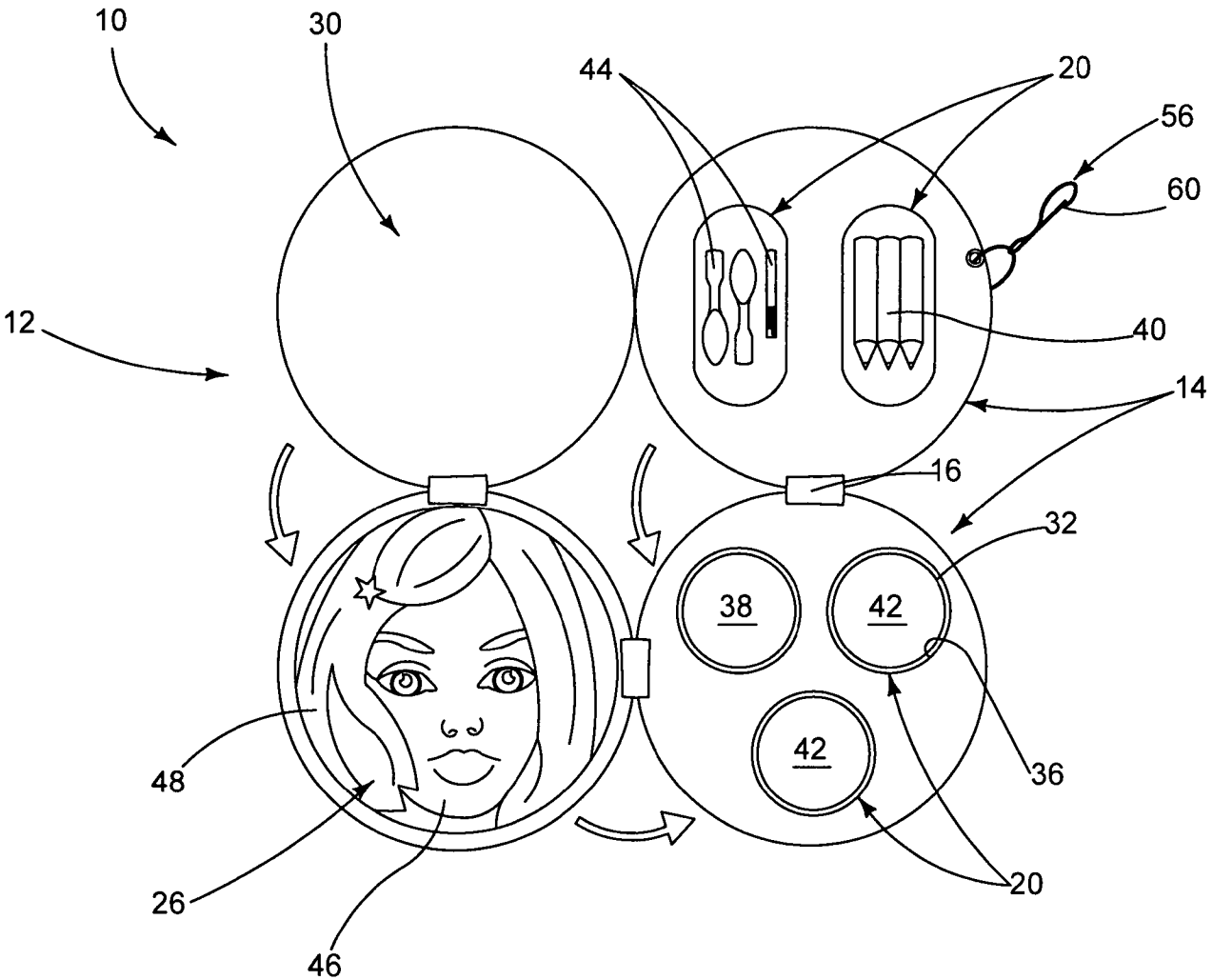
FIG. 6 illustrates a multi-portioned exemplary device in an open configuration in which the panels are coupled to one another by hinges.

FIG. 6 illustrates another exemplary device 10 having four portions 14. The portions may be coupled at various locations to form a configuration that provides additional storage areas 20 while being foldable to a compact closed configuration. The additional portion may provide further storage areas for cosmetics and accessories or may provide additional facial sculpts, mirrors, and the like. The device may also include a fastening member 56 including a clasp 60 to attach the device to another object, such as a purse or backpack.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

I claim:

1. A toy container comprising:

a first portion adapted to contain one or more cosmetics retained in one or more cosmetic containers, wherein the first portion includes a corresponding number of cavities configured to releasably receive the cosmetic containers, and wherein one or more cavities extend through the first portion, such that the corresponding cosmetic containers are accessible from both a front side and a back side of the first portion;

a second portion including a washable doll section that further includes a three-dimensional facial sculpt having contours of a human face; and a substantially transparent panel forming a protective cover for the second portion, wherein:

the first and second portions are hinged and adapted to fold flat against one another; and the cosmetics are folded behind the three-dimensional facial sculpt so that both the cosmetics and the three-dimensional facial sculpt are exposed, when the first and second portions are folded flat against one another.

2. The toy container of claim 1, wherein the toy container is a styling compact.

3. The toy container of claim 1, wherein the doll section includes hair having an adjustable length.

4. The toy container of claim 3, further comprising hair accessories.

5. The toy container of claim 1, further comprising jewelry adapted to be coupled to the doll section.

6. The toy container of claim 1, wherein the substantially transparent panel includes images configured to overlay the doll section.

7. The toy container of claim 1, further comprising a mirror coupled to a side of the second portion opposite the doll section.

8. The toy container of claim 1, wherein the first and second portions are openable to a position in which the cosmetics and the three-dimensional facial sculpt are simultaneously exposed and accessible.

9. The toy container of claim 1, wherein the corresponding cosmetic containers are removable from both the front side and the back side of the first portion.

10. The toy container of claim 1, wherein the cosmetic containers accessible from both sides of the first portions are openable from either side of the first portion.

11. The toy container of claim 1, wherein the first portion includes a corresponding number of cavities configured to releasably receive the cosmetics.

12. A toy container comprising:

a first panel adapted to contain one or more cosmetics accessible from a front side thereof, wherein:

the cosmetics are retained in one or more cosmetic containers, the first panel includes a corresponding number of cavities configured to releasably receive the cosmetic containers, and one or more cavities extend through the first panel, such that the corresponding cosmetic containers are accessible from both a front side and a back side of the first panel;

a second panel including a three-dimensional facial sculpt on a front side thereof; and a substantially transparent panel forming a protective cover for the facial sculpt;

wherein the first and second panels are hinged and adapted to fold flat against one another into a folded position in which the cosmetics are folded behind the three-dimensional facial sculpt so that both the cosmetics and the three-dimensional facial sculpt are exposed, and are also adapted to open into an unfolded position in which the front sides of the cosmetics and the three-dimensional facial sculpt are simultaneously exposed and accessible; and wherein the substantially transparent panel is movable to selectively cover and uncover the facial sculpt in either of the positions.

13. A toy container comprising:

a first portion adapted to contain one or more cosmetics retained in one or more cosmetic containers, wherein the first portion includes a corresponding number of cavities configured to releasably receive the cosmetic containers, and wherein one or more cavities extend through the first portion, such that the corresponding cosmetic containers are accessible from both a front side and a back side of the first portion;

a second portion including a three-dimensional facial sculpt defining a washable doll section; and a substantially transparent panel forming a protective cover for the second portion;

wherein the first portion and transparent panel are movably attached to the second portion, such that the container may be moved from a closed position in which the second portion overlays the first portion so that the cosmetics are behind the three-dimensional facial sculpt, and the transparent panel overlays the second portion, and an open position in which the first portion and transparent panel extend away from the second portion so that the cosmetics and the three-dimensional facial sculpt are simultaneously exposed and accessible.

* * * * *